US011390096B2

(12) United States Patent
Yamamuro et al.

(10) Patent No.: US 11,390,096 B2
(45) Date of Patent: Jul. 19, 2022

(54) EJECTION APPARATUS AND DEPOSITION SUPPRESSION METHOD

(71) Applicant: CANON KABUSHIKI KAISHA, Tokyo (JP)

(72) Inventors: Tomoki Yamamuro, Kanagawa (JP); Kazuo Suzuki, Kanagawa (JP); Toshimitsu Danzuka, Tokyo (JP); Yasunori Fujimoto, Tokyo (JP); Masataka Kato, Kanagawa (JP); Kazuki Narumi, Tokyo (JP); Hiroto Kango, Tokyo (JP); Kazuhiko Sato, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/096,792

(22) Filed: Nov. 12, 2020

(65) Prior Publication Data

US 2021/0155002 A1 May 27, 2021

(30) Foreign Application Priority Data

Nov. 22, 2019 (JP) ..... JP2019-211539

(51) Int. Cl.

| | |
|---|---|
| ***B41J 11/00*** | (2006.01) |
| ***B41J 11/02*** | (2006.01) |
| ***B41J 11/06*** | (2006.01) |
| ***B41J 2/165*** | (2006.01) |

(52) U.S. Cl.

CPC ..... *B41J 11/0065* (2013.01); *B41J 2/16535* (2013.01); *B41J 11/02* (2013.01); *B41J 11/06* (2013.01)

(58) Field of Classification Search

CPC .... B41J 11/0065; B41J 2/16535; B41J 11/02; B41J 11/06

See application file for complete search history.

(56) References Cited

U.S. PATENT DOCUMENTS

| | | | | |
|---|---|---|---|---|
| 10,493,749 | B2 * | 12/2019 | Yamamuro | B41J 2/16505 |
| 11,198,309 | B2 * | 12/2021 | Yamamuro | B41J 2/16523 |
| 2012/0050400 | A1 | 3/2012 | Takahashi | |

FOREIGN PATENT DOCUMENTS

| | | | |
|---|---|---|---|
| JP | 2004167945 | A | 6/2004 |

* cited by examiner

*Primary Examiner* — Geoffrey S Mruk

(74) *Attorney, Agent, or Firm* — Canon U.S.A., Inc., IP Division

(57) ABSTRACT

An ejection apparatus includes a platen for supporting a recording medium, an absorber provided in the platen for absorbing liquid, an ejection unit for ejecting a plurality of types of ink including a first liquid containing a component to be deposited when the first liquid is ejected onto the absorber, and a second liquid different from the first liquid for suppressing deposition of the first liquid, a detection unit for detecting a state of a predetermined region of the absorber, and a control unit for controlling the detection unit to detect the state, and controlling the ejection unit to eject the second liquid to the predetermined region based on a result of the detection. When the first liquid is ejected to the predetermined region, the second liquid is ejected to the predetermined region after the ejection of the first liquid is finished, without using the result of the detection.

21 Claims, 12 Drawing Sheets

EJECTION APPARATUS AND DEPOSITION SUPPRESSION METHOD

BACKGROUND OF THE INVENTION

Field of the Invention

The present disclosure relates to an ejection apparatus and a deposition suppression method.

Description of the Related Art

When borderless recording or preliminary ink ejection is performed in an inkjet recording apparatus, ink is ejected to a region outside a recording medium. In order to prevent the ejected ink from soiling the inside of the apparatus, some inkjet recording apparatuses include an ink absorber disposed at a position outside a recording medium and opposing the movement path of a recording head. However, such recording apparatuses are often troubled by ink deposited on the surface of the ink absorber.

Japanese Patent Application Laid-Open No. 2004-167945 discusses a technique for detecting ink deposited on the scanning path of a recording head in the main body of a recording apparatus. The recording apparatus is provided with a detection unit including a light emission unit and a light receiving unit. The detection unit detects the height of the deposited ink by receiving, by the light receiving unit, light emitted from the light emission unit. Japanese Patent Application Laid-Open No. 2004-167945 also discusses a technique in which, when deposition is detected, ink less likely to deposit than other types of ink is ejected to the deposition, so that solidified ink is re-fluidized and absorbed by an absorption unit. United States Patent Application Publication No. 2012/0050400 discusses a technique in which ink is ejected to an absorber after borderless recording in order to suppress the deposition of ink.

However, it has been found out that, some types of ink are difficult to recover from the deposited state once being solidified, depending on the property, and such types of ink require a large amount of ink for re-fluidization. In the case of using ink with such a property, if deposition is to be re-fluidized after the detection of the deposition, the amount of ink to be applied to the deposition for re-fluidization is large.

SUMMARY OF THE INVENTION

The present disclosure is directed to eliminating the deposition of ink and also reducing the amount of ink required to eliminate the deposition, even when ink difficult to recover from the deposited state once being deposited is ejected onto an absorber.

According to an aspect of the present disclosure, an ejection apparatus includes a platen configured to support a recording medium, an absorber provided in the platen and configured to absorb a liquid, an ejection unit configured to eject a plurality of types of ink including at least a first liquid containing a component to be deposited in a case where the first liquid is ejected onto the absorber, and a second liquid being a different type of liquid from the first liquid and being capable of suppressing deposition of the first liquid, a detection unit configured to detect a state of a predetermined region of the absorber, and a control unit configured to control the detection unit to detect the state of the predetermined region, and control the ejection unit to eject the second liquid to the predetermined region based on a result of the detection by the detection unit. In a case where the first liquid is ejected to the predetermined region in an ejection operation, the control unit controls the ejection unit to eject the second liquid to the predetermined region after the ejection of the first liquid to the predetermined region is finished, without using the result of the detection by the detection unit.

Further features of the present disclosure will become apparent from the following description of exemplary embodiments with reference to the attached drawings.

DESCRIPTION OF THE EMBODIMENTS

Hereinafter, an exemplary embodiment of the present disclosure will be described in detail with reference to the drawings.

(Recording Apparatus Configuration)

Figure 1:
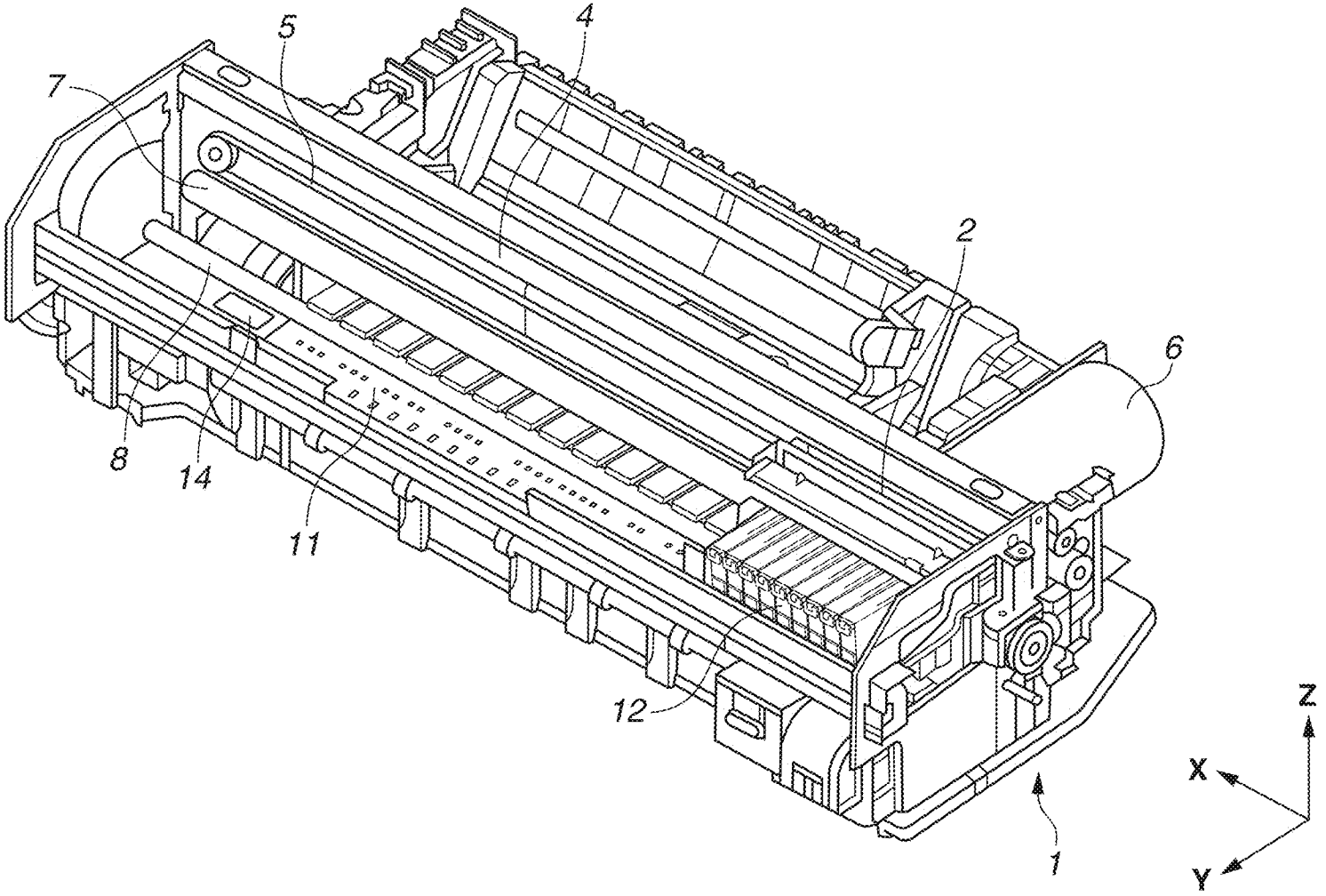
FIG. 1 is a perspective view illustrating a recording apparatus according to an exemplary embodiment.

FIG. 1 is a perspective view illustrating an internal mechanism of an inkjet recording apparatus 1 (hereinafter, simply referred to as a recording apparatus 1) according to the present exemplary embodiment. The recording apparatus 1 according to the present exemplary embodiment mainly includes a feeding unit that feeds a recording medium P, a conveyance unit that conveys the recording medium P, a discharge unit that discharges the recording medium P having a recorded image thereon, and a recovery unit that recovers the recording performance of a recording unit.

The feeding unit includes a feeding tray on which a plurality of sheets of the recording medium P is stacked, and a feeding roller that feeds the plurality of sheets of the recording medium P, which is stacked on the feeding tray, one by one to the inside of the recording apparatus 1.

The conveyance unit includes a conveyance roller 8 that conveys the recording medium P fed from the feeding unit, and a pinch roller 9 (refer to FIG. 2) that is provided at a position opposing the conveyance roller 8 and pinches the recording medium P with the conveyance roller 8.

The recording unit includes a recording head 3 (refer to FIG. 2) having an ejection port surface 20 (refer to FIG. 2) on which ejection ports are provided to eject ink, and a carriage 2 that detachably mounts the recording head 3 thereon. The carriage 2 is configured to reciprocate in an X direction (moving direction of the carriage 2) along a guide shaft 7 via a timing belt 5 attached to a chassis 4, when a carriage motor 6 is driven. The recording medium P is conveyed in a Y direction intersecting with the X direction. The recording head 3 records an image by ejecting ink onto the recording medium P stopped at a position opposing the recording head 3, while the carriage 2 is reciprocating. A platen 15 (refer to FIG. 2) for supporting the recording medium P from below is provided at the position opposing the recording head 3 so as to keep constant a distance between the surface (first surface) of the recording medium P and the ejection port surface 20 of the recording head 3. The platen 15 is provided with an absorber 21 (refer to FIG. 2) that absorbs and holds ink ejected outside the recording medium P.

The discharge unit includes discharge rollers 10 (refer to FIG. 2) that discharge the recording medium P having a recorded image thereon, to the outside of the recording apparatus 1, and spur rollers 11 that press the recording medium P at a position opposing the discharge rollers 10.

The recovery unit includes a cap 30 (refer to FIG. 5) that is on the outside of a recording region in the moving direction of the carriage 2 and is used to cover the ejection port surface 20 of the recording head 3. The cap 30 includes an absorber that absorbs ink. By bringing the absorber into contact with the ejection port surface 20, the cap 30 covers the ejection port surface 20. When the recording head 3 is not operated, the recording head 3 stands by in a state of being capped by the cap 30. The position of the carriage 2 in FIG. 1 is a standby position at which the recording head 3 stands by. The recovery unit further includes a suction mechanism that sucks ink from the recording head 3 by driving a suction pump 31 (refer to FIG. 5) connected with the cap 30 via a tube (not illustrated), in a state where the cap 30 covers the ejection port surface 20 of the recording head 3. The recovery unit further includes a wiper 32 that wipes the ejection port surface 20 of the recording head 3.

A reference plate 14 for checking whether an output from a detection sensor 13 (refer to FIG. 3) to be described below is correct is provided next to the platen 15 in the X direction.

Figure 2:
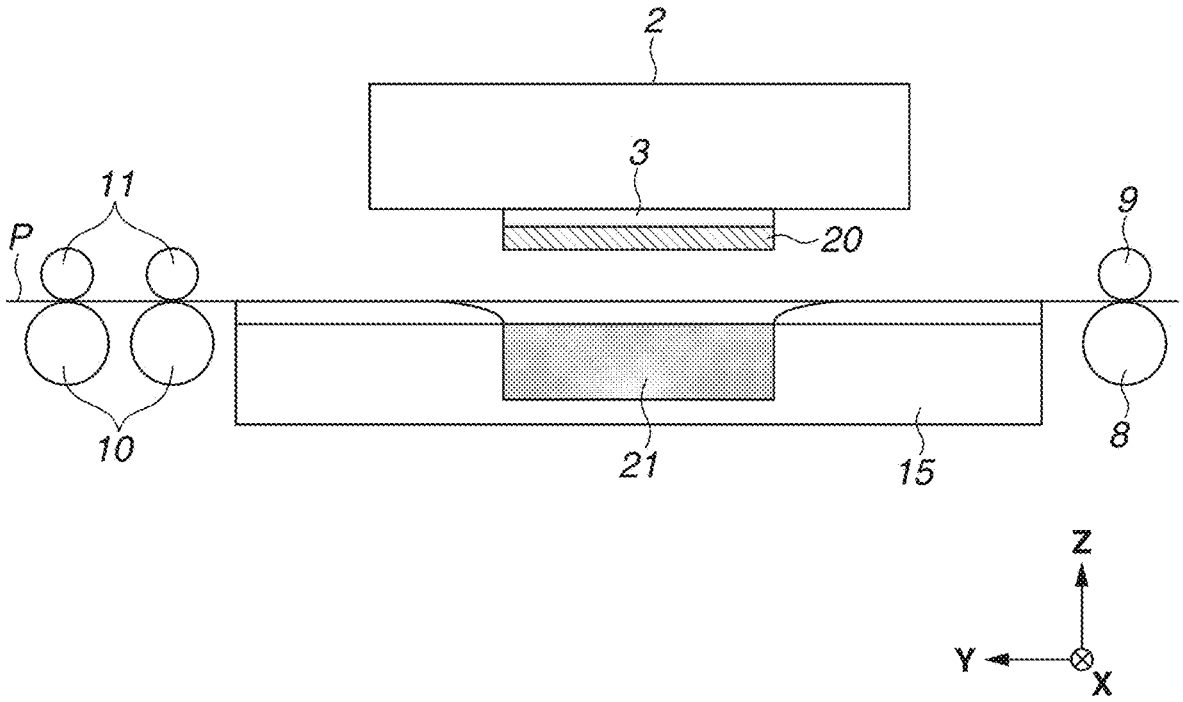
FIG. 2 is a schematic cross-sectional diagram illustrating a periphery of a recording unit according to the exemplary embodiment.

Next, a configuration of a periphery of the recording unit will be described in detail. FIG. 2 is a schematic cross-sectional diagram viewed from the X direction in FIG. 1, which illustrates the periphery of the recording unit according to the present exemplary embodiment. The recording medium P fed from the feeding unit is conveyed while being pinched by the conveyance roller 8 and the pinch roller 9 that are provided on the upstream side of the recording head 3 in the Y direction. In addition, the recording medium P is also pinched by the discharge rollers 10 and the spur rollers 11 that are provided on the downstream side of the recording head 3 in the Y direction. The recording medium P is pinched and conveyed while the surface of the recording medium P is kept flat, in a state where tension is generated between the conveyance roller 8 and the pinch roller 9 and between the discharge rollers 10 and the spur rollers 11. The recording medium P being conveyed is supported by the platen 15 from below.

While the conveyance of the recording medium P is stopped, ink droplets are ejected from the ejection ports of the recording head 3 mounted on the carriage 2 that is moving in the X direction, so that an image corresponding to one band (one line break) is recorded onto the recording medium P. When the image corresponding to one band is recorded, the recording medium P is conveyed in the Y direction by a predetermined amount by the conveyance roller 8 being driven by a conveyance motor (not illustrated). By alternately repeating the reciprocation of the carriage 2 and the ink droplet ejection performed by the recording head 3, and the conveyance (intermittent conveyance) of the recording medium P by a predetermined amount performed by the conveyance roller 8, an image is recorded on the entire recording medium P.

(Recording Head)

Figure 3:
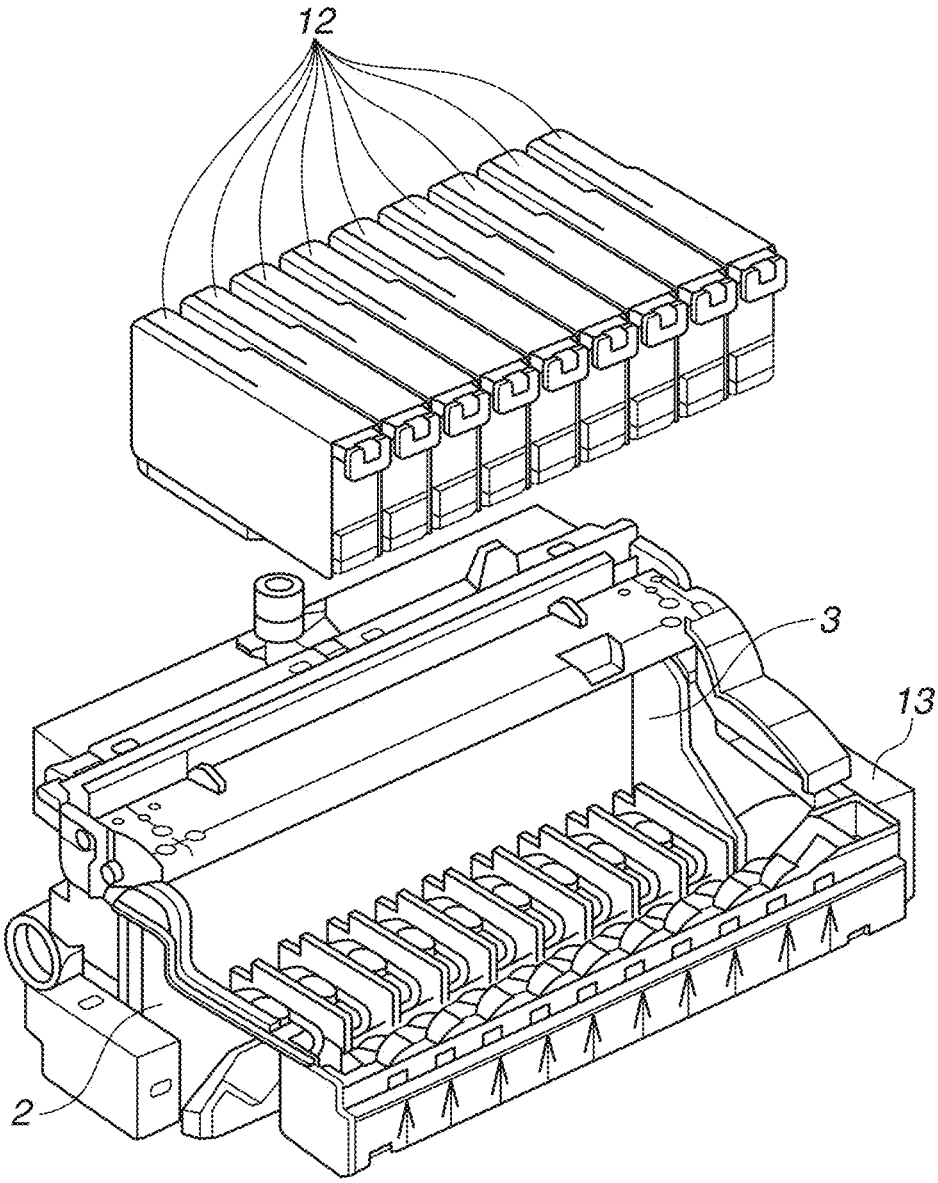
FIG. 3 is a perspective view illustrating a configuration of the recording unit according to the exemplary embodiment.

FIG. 3 is a perspective view illustrating a configuration of the recording unit according to the present exemplary embodiment. The recording head 3 is detachably mounted on the carriage 2. In addition, nine types of ink tanks (ink cartridges) 12 are detachably inserted into the recording head 3. The recording apparatus 1 records an image using nine types of ink. The nine independent ink tanks 12 are inserted into the recording head 3. In the present exemplary embodiment, nine types of pigment ink including cyan ink, magenta ink, yellow ink, black ink, red ink, light cyan ink, light magenta ink, gray ink, and clear ink are used. For the sake of convenience, in the present exemplary embodiment, clear ink is also treated as pigment ink, but does not contain pigment components. In the present exemplary embodiment, among the nine types of ink used, dark color ink such as magenta ink, cyan ink, yellow ink, black ink, and red ink contains a lot of solid components. Thus, such ink is easy to solidify, difficult to be absorbed by the absorber 21, and easy to deposit, and is therefore collectively referred to as deposition ink. On the other hand, light cyan ink, light magenta ink, gray ink, and clear ink contain a small amount of solid components. Thus, such ink can be easily absorbed by the absorber 21 and can promote the absorption of deposited pigment ink, and is therefore collectively referred to as deposition suppression ink. In the present exemplary embodiment, the deposition ink contains a higher ratio of pigment, which is a solid component, than the deposition suppression ink. In addition, among the types of deposition ink, ink that can easily recover from the deposited state by using the deposition suppression ink even if being deposited is referred to as re-fluidization ink, and ink difficult to recover from the deposited state using the deposition suppression ink once being deposited is referred to as aggregation ink. The classification method will be described in detail below.

On the ejection port surface 20 of the recording head 3, a plurality of ejection port arrays for ejecting the respective ink colors is arranged in the Y direction. A recording element is arranged immediately above each of the ejection ports (in plus Z direction). The recording element is an electrothermal conversion element. Thermal energy is generated by application of a voltage to the recording element, so that ink is ejected from the ejection port by the thermal energy. In addition, instead of the electrothermal conversion element, a piezoelectric element, an electrostatic element, or a micro-electromechanical system (MEMS) element can also be used as the recording element.

The carriage 2 is provided with the detection sensor 13 serving as a detection unit including a light emission unit 201 (refer to FIG. 6) that emits light and a light receiving unit 203 (refer to FIG. 6) that receives light specularly reflected after being emitted from the light emission unit 201. The detection sensor 13 uses the light emission unit 201 to emit light at a predetermined angle to an inspection target that is at a predetermined position in the moving direction of the carriage 2, and uses the light receiving unit 203 to receive specularly reflected light from the inspection target. The detection sensor 13 will be described in detail below.

(Platen Unit)

Figure 4:
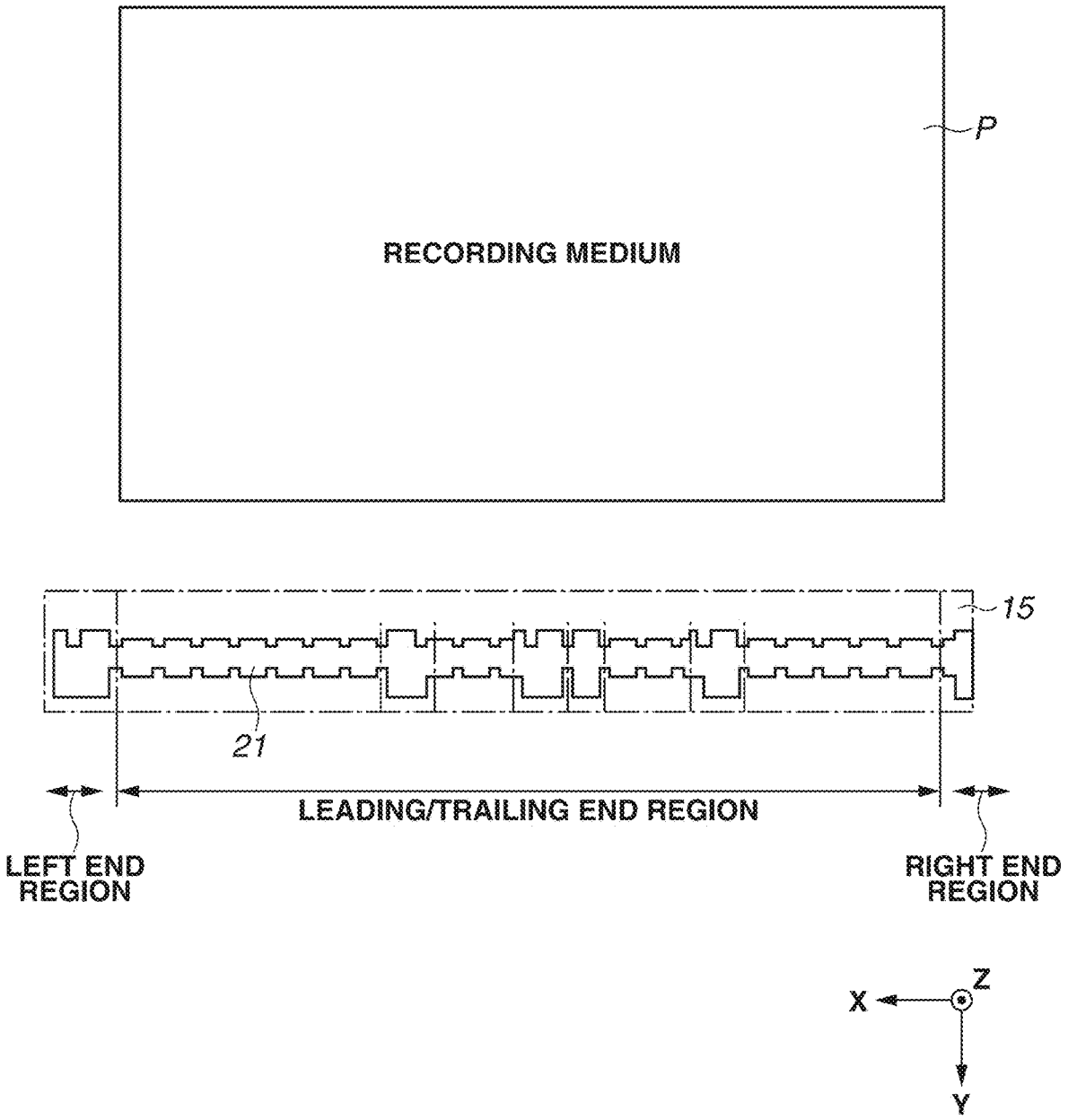
FIG. 4 is a diagram illustrating a relationship between a recording medium and an absorber according to the exemplary embodiment.

FIG. 4 is a diagram illustrating the recording medium P and the platen 15 viewed from above, and illustrates a relationship between the recording medium P and the absorber 21 provided in the platen 15 in borderless recording.

The platen 15 extends in a main scanning direction along a scanning path of the recording head 3 in order to support the conveyed recording medium P from below. The platen 15 includes the absorber 21 for absorbing ink ejected outside the recording medium P during borderless recording. The absorber 21 also absorbs ink ejected during a preliminary ejection operation that is performed to maintain or improve the ejected state of ink and does not contribute to recording. In the present exemplary embodiment, the absorber 21 is in the form of a sponge so as to easily absorb ink, and has asperities on the surface. The ink absorbed by the absorber 21 is thereafter collected by a waste ink container (not illustrated) provided in the lower part of the recording apparatus 1. The waste ink container also collects ink discharged to the cap 30. In the present exemplary embodiment, when borderless recording is performed, ink is ejected from the recording head 3 up to a region protruding outward about 3 mm from the ends of the recording medium P. Referring to FIG. 4, during borderless recording on the recording medium P, when recording is performed onto the leading end and the trailing end of the recording medium P, ink is ejected to a leading/trailing end region, a left end region, and a right end region of the absorber 21. When recording is performed onto the other portions of the recording medium P, ink is ejected to the left end region and the right end region of the absorber 21.

(Block Diagram)

Figure 5:
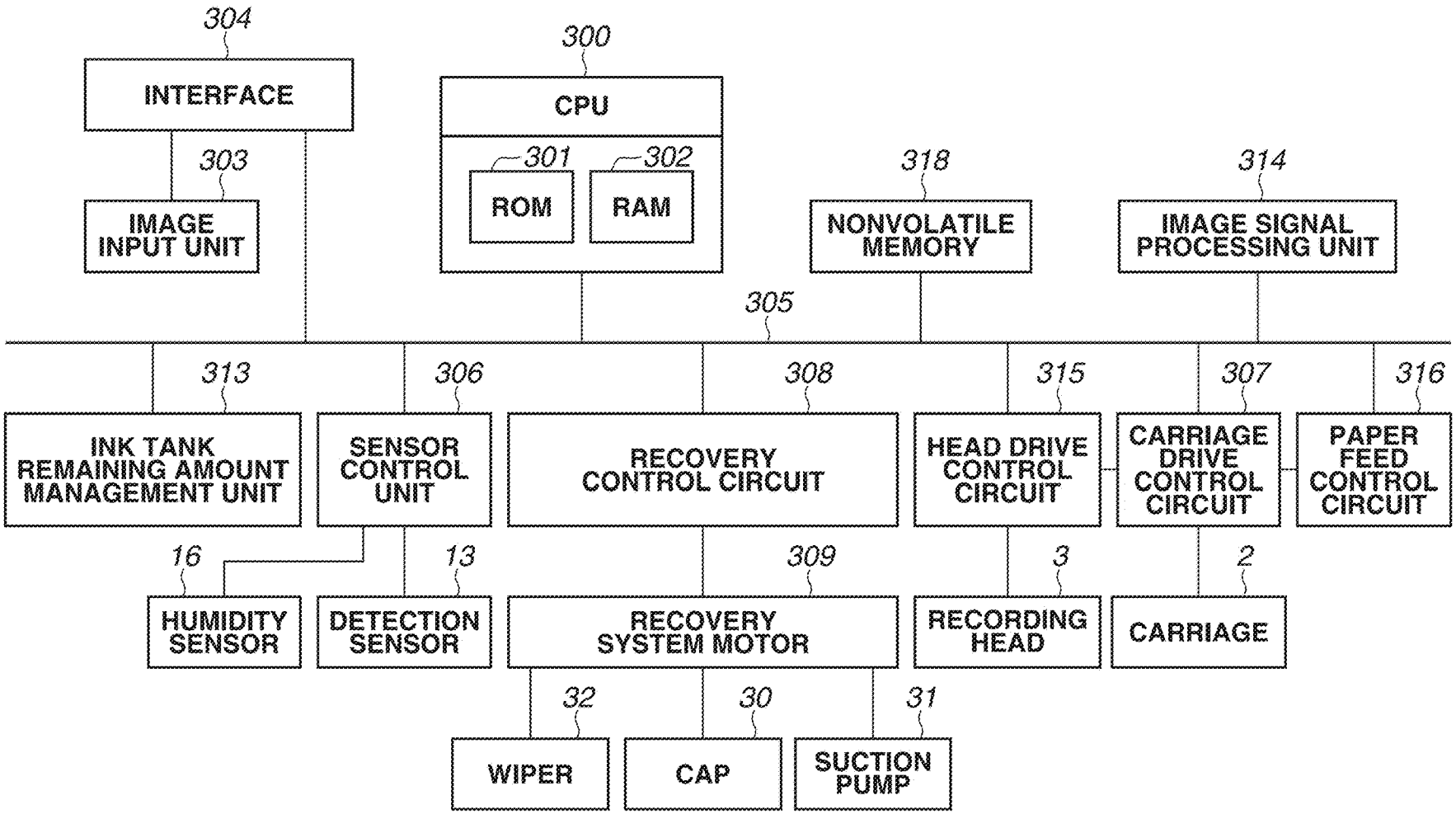
FIG. 5 is a block diagram illustrating an entire control configuration of the recording apparatus according to the exemplary embodiment.

FIG. 5 is a block diagram illustrating the entire control configuration of the recording apparatus 1 according to the present exemplary embodiment. A central processing unit (CPU) 300 includes a read-only memory (ROM) 301 and a random access memory (RAM) 302. The CPU 300 controls data processing, driving of the recording head 3, and driving of the carriage 2 via the components to be described below and performs a recording operation and a maintenance operation including a preliminary ejection operation, based on a program stored in the ROM 301. The RAM 302 is used as a work area for data processing or the like by the CPU 300, and temporarily stores recording data obtained by performing a plurality of scans, and parameters related to a recovery processing operation and a supply operation of the recording apparatus 1. The recording apparatus 1 can connect to a host apparatus via an interface 304. The CPU 300 performs communication processing with the host apparatus via the interface 304.

A nonvolatile memory 318 stores information such as the amount of ink stored in the waste ink container, the amount of ink discharged to the absorber 21, a discharge time, and ink information. The nonvolatile memory 318 can hold the information even if the recording apparatus 1 is powered OFF. The amount of ink discharged to the absorber 21 is measured by counting, based on recording data, the amount of ink ejected to the outside of the recording medium P. In addition, the amount of ink stored in the waste ink container is calculated by counting the amount of ink discharged to the absorber 21 and to the cap 30, and multiplying the counted ink amount by an evaporation coefficient. An ink tank remaining amount management unit 313 manages information regarding the remaining amount of each of the ink tanks 12 based on the ink information stored in the nonvolatile memory 318. The CPU 300 displays, on a display connected to the host apparatus, a warning prompting a user to replace any of the ink tanks 12 if the remaining amount thereof stored in the ink tank remaining amount management unit 313 is equal to or smaller than a predetermined amount.

A recovery control circuit 308 controls driving of a recovery system motor 309, and controls a recovery operation such as an up-down operation of the cap 30, an operation of the wiper 32, and an operation of the suction pump 31.

An image input unit 303 temporarily stores image data input from the host apparatus via the interface 304. The image data input to the image input unit 303 is subjected to predetermined image processing by an image signal processing unit 314, so that recording data available for a recording operation is generated. The recording head 3 and the carriage 2 are controlled based on the recording data.

A head drive control circuit 315 drives the recording elements of the recording head 3. By driving the recording elements, the head drive control circuit 315 causes the recording head 3 to perform an ink ejection operation or a preliminary ejection operation. A carriage drive control circuit 307 controls the reciprocation of the carriage 2 in the main scanning direction (X direction), and also controls the movement of the carriage 2 to move the recording head 3 above a maintenance unit in order to perform a suction operation. A paper feed control circuit 316 controls driving of the conveyance motor based on a program stored in the RAM 302.

A sensor control unit 306 controls the detection sensor 13 and a humidity sensor 16. The detection sensor 13 emits light from the light emission unit 201 to the absorber 21, and outputs, as a voltage, the amount of specularly reflected light received by the light receiving unit 203. The humidity sensor 16 is provided in the recording apparatus 1, and measures the humidity inside the recording apparatus 1.

(Details of Detection Sensor)

Figure 6:
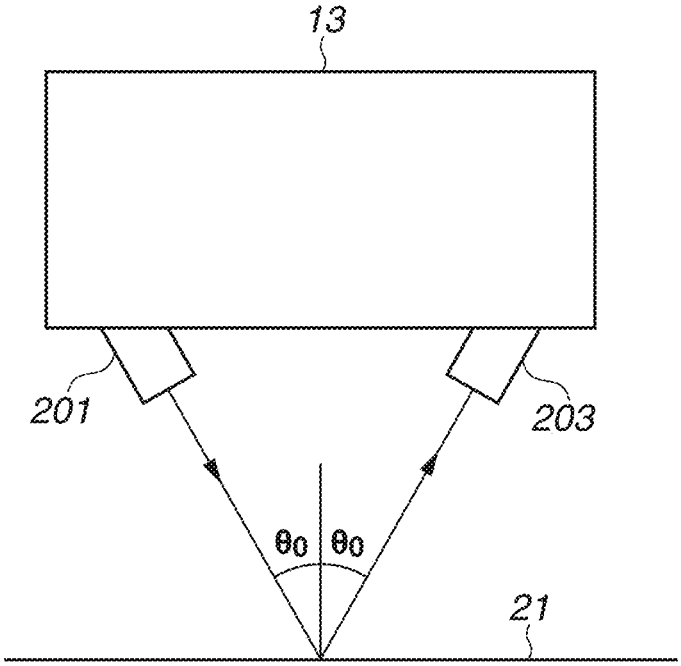
FIG. 6 is a diagram illustrating a function of a detection sensor according to the exemplary embodiment.

FIG. 6 is a diagram illustrating the detection sensor 13 provided in the carriage 2, and the detection of specularly reflected light from the absorber 21. As described above, the detection sensor 13 includes the light emission unit 201 and the light receiving unit 203. The light emission unit 201 includes a red light-emitting diode (LED) as a sensor light source, and emits sensor light to the absorber 21 at a predetermined angle $\theta_0$. The light receiving unit 203 is a phototransistor, and receives light reflected by the absorber 21. In order to receive specularly reflected light from the absorber 21, the light receiving unit 203 is arranged at a position at which both an incident angle and a reflection angle are equal to the predetermined angle $\theta_0$. The larger the amount of light received by the light receiving unit 203 is, the higher the output voltage is.

To check whether the output voltage is correct, the detection sensor 13 is moved above the reference plate 14 to emit light from the light emission unit 201 to the reference plate 14 and receive reflected light from the reference plate 14 using the light receiving unit 203. If the output voltage corresponding to the received reflected light falls within a preset range, the output voltage is determined to be normal. In the present exemplary embodiment, the reference plate 14 is positioned on the opposite side of the standby position in the X direction, but the reference plate 14 may be provided on the same side as the standby position in the X direction. By providing the reference plate 14 on the same side as the standby position, the reference plate 14 and the standby position are located nearby, and thus the time to move the detection sensor 13 is shortened and the time required to determine whether the output voltage is normal can be reduced.

(Deposition of Ink)

When ink is to be deposited on the absorber 21, first of all, moisture in the ink is vaporized in the absorber 21 and viscosity of the ink increases. This causes the ink to fail to reach the waste ink container, stay in the absorber 21, and become solidified. At this time, solid components in the ink are solidified. The solid components are mainly pigment. Non-vaporized moisture is also included therein.

Ink accumulated on the solidified ink also becomes solidified in the absorber 21 due to the moisture being vaporized. As a result, the ink is deposited up to a height equal to the surface of the absorber 21. Due to the ink being solidified on the surface, the asperities on the surface are filled with ink, and the surface becomes smoother than that in a state where no ink adheres to the absorber 21. After that, if the absorber 21 becomes unable to absorb the ink any more, the ink is further deposited. In the present exemplary embodiment, the state where the surface of the absorber 21 is smoother than the original state due to the ink being deposited and solidified up to the surface is regarded as a state where ink is deposited.

Figure 7A:
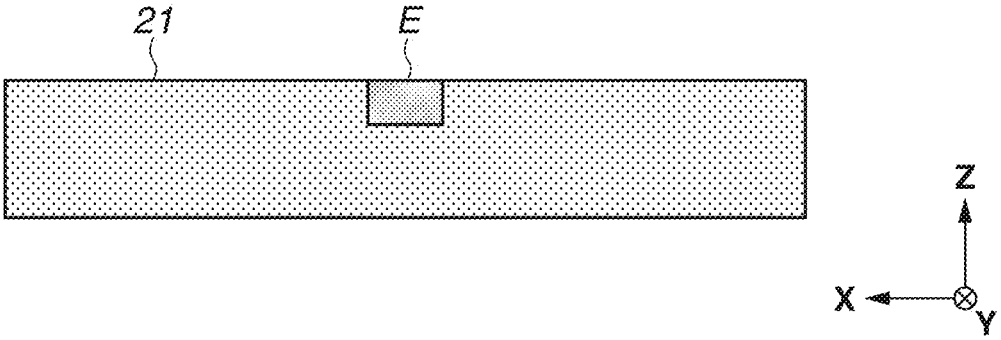
FIGS. 7A and 7C are diagrams each illustrating deposition detection according to the exemplary embodiment.

FIG. 7A is a schematic diagram illustrating a state where ink is deposited in a range in which the ink is ejected onto the absorber 21. Because the ejection ports of the recording head 3 are arrayed in the Y direction, when borderless recording or preliminary ejection is performed, ink is ejected in a range extending in the Y direction, and an ink deposition range extends also in the Y direction. However, because the carriage 2 moves only in the X direction and the processing position is changed with respect to the X direction, only the description about a position in the X direction will be given here.

Figure 7B:
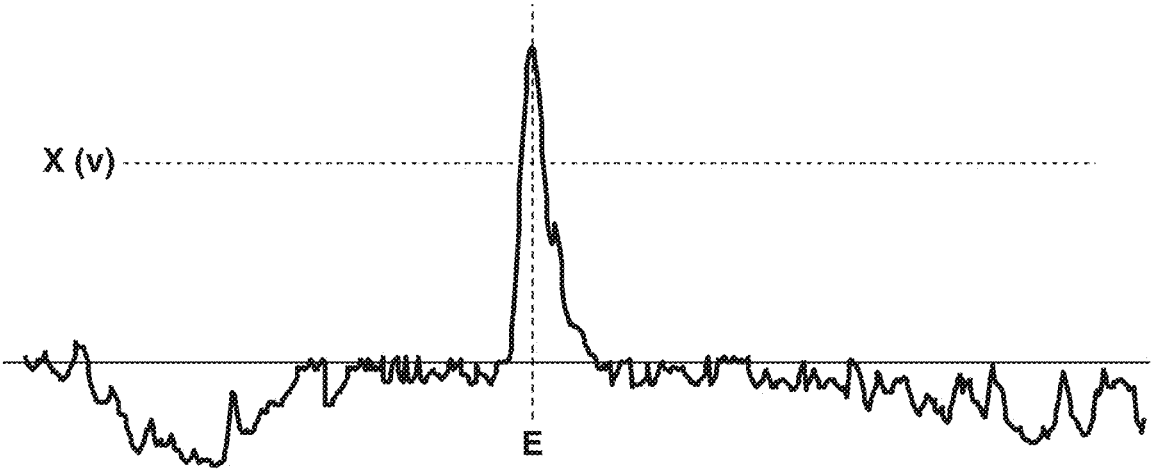
FIG. 7B is a graph illustrating the deposition detection according to the exemplary embodiment.

FIG. 7A illustrates a state where ink is deposited on a part of the absorber 21. An area in which ink is deposited is displayed in a darker color than that of the other area. When the detection sensor 13 detects a position E, the deposition suppression ink is ejected based on the detection, so that ink deposition in a certain degree of range can be reduced. In the example illustrated in FIG. 7A, the area where ink is deposited falls within a range in which ink deposition can be reduced, and the position E is a center position in the range. FIG. 7B is a graph indicating output results from the detection sensor 13 that correspond to the positions in FIG. 7A. As illustrated in FIG. 7A, when ink is deposited on the absorber 21, the asperities on the surface are filled with solidified ink, and thus the area, in the surface, where the ink is deposited becomes smoother than the other area. In order to detect the ink deposition illustrated in FIG. 7A, the detection sensor 13 emits sensor light to the position E using the light emission unit 201. When sensor light is emitted to the position E, the intensity of specularly reflected light from the position E where the ink is deposited is higher than that from the surface of the absorber 21 where no ink is deposited. The same applies to a case where the deposition further progresses. In the graph illustrated in FIG. 7B, at the position E, the output value is equal to or larger than a threshold value X (v). By determining that ink is deposited at the position E having an output value equal to or greater than the threshold value X (v), it is possible to detect a state in which ink is deposited in a range in which the deposition of ink can be reduced.

Figure 7C:
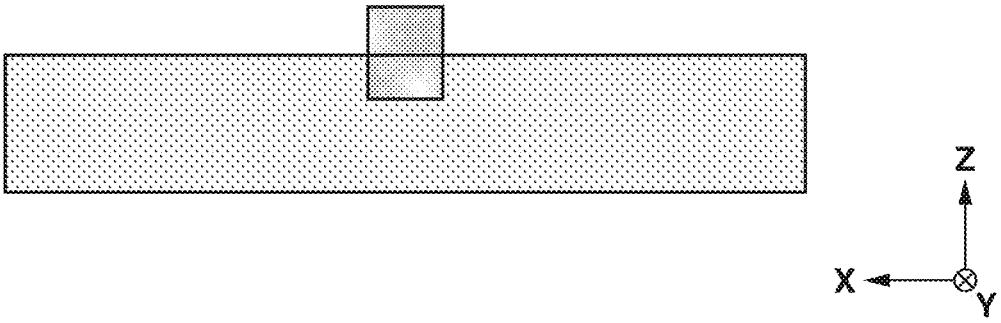

FIG. 7C is a diagram illustrating a state where the ink deposition in FIG. 7A has further progressed. If ink is deposited up to a height equal to or larger than a predetermined value, the back surface of the recording medium P becomes dirty.

In the present exemplary embodiment, if the output value is equal to or larger than the threshold value X (v), it is determined that ink is deposited. Alternatively, another method may be used. For example, comparison may be made with a value detected in a state where the absorber 21 is not soiled, and it may be determined that ink is deposited, when a difference between the two output values is equal to or larger than a predetermined value. The detected value in the state where the absorber 21 is not soiled may be preset, or may be obtained when the use of the recording apparatus 1 is started.

In the present exemplary embodiment, the example in which ink deposition is detected based on the specularly reflected light has been described. Alternatively, ink deposition may be detected using diffused reflection, or based on a difference in reflection intensity due to the height of deposited state.

(Classification of Ink)

When ink is ejected onto the absorber 21, some types of ink (hereinafter referred to as deposition ink) become solidified and easily deposited on the absorber 21, and the other types of ink (hereinafter referred to as deposition suppression ink) are difficult to deposit. The deposition suppression ink can be easily absorbed into the absorber 21, and can promote the absorption of deposited pigment ink.

In addition, the deposition ink (easy-to-deposit ink) includes ink (hereinafter referred to as aggregation ink) that is difficult to recover from the deposited state. The aggregation ink requires a large amount of deposition suppression ink to be ejected for re-fluidization and recovery from the deposited state. The deposition ink other than the aggregation ink is referred to as re-fluidization ink.

Hereinafter, an evaluation method according to the present exemplary embodiment for defining the deposition ink and the deposition suppression ink, and further defining the aggregation ink and the re-fluidization ink in the deposition ink will be described.

(Evaluation 1)

The evaluation is intended to define the deposition ink and the deposition suppression ink.

Regarding ink deposition, the following evaluation was performed. In the present exemplary embodiment, a solid image recorded by ejecting eight ink droplets each having a mass of 3.5 ng, to a region with 1/600 inches×1/600 inches is defined to have a recording duty ratio of 100%. For each type of ink, borderless recording was performed on the entire surface of an A4-sized recording medium at a recording duty ratio of 25%. After the recording was performed onto 500 sheets of the recording medium, the state of the absorber 21 was visually checked and evaluated for deposition. If a state where the surface of the absorber 21 is filled with ink or a state where the ink is deposited up to a height higher than the surface has been visually observed, it is determined that the ink is deposited.

Figure 8A:
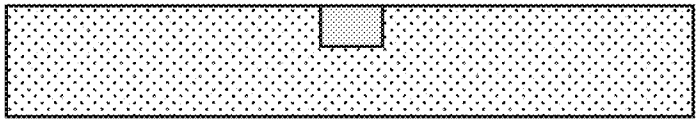
FIGS. 8A to 8F are diagrams each illustrating a state of the absorber in an evaluation according to the exemplary embodiment.
Figure 8B:
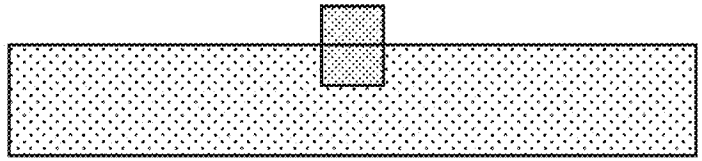

FIGS. 8A and 8B are schematic diagrams each illustrating a result of the above-described test using the above-described nine types of pigment ink. Light cyan ink, light magenta ink, gray ink, and clear ink were brought into a state illustrated in FIG. 8A, and no deposition occurred. These types of ink contain a small amount of solid components, and are thus difficult to deposit and can be easily absorbed by the absorber 21. These types of ink are not deposited even if being ejected onto the absorber 21, and also act to promote the absorption of deposited pigment ink. For the above-described reason, light cyan ink, light magenta ink, gray ink, and clear ink are defined as the deposition suppression ink.

On the other hand, deposition of black ink, magenta ink, yellow ink, red ink, and cyan ink occurred as illustrated in FIG. 8B. These types of ink are dark color ink having a high solid component ratio with respect to moisture, and can easily become solidified and are difficult to be absorbed by the absorber 21 if moisture in the ink is vaporized. For the above-described reason, black ink, magenta ink, yellow ink, red ink, and cyan ink are defined as the deposition ink.

(Evaluation 2)

The evaluation is intended to define the aggregation ink and the re-fluidization ink in the deposition ink. In a case where deposition is caused by the re-fluidization ink ejected onto the absorber, it is easier to re-fluidize the deposition by ejecting the deposition suppression ink to the deposition, than in a case where deposition is caused by the aggregation ink ejected onto the absorber.

In the evaluation 1, the deposition ink ejected onto the absorber 21 was brought into the state illustrated in FIG. 8B. In the evaluation 2, a borderless recording operation was performed once at a recording duty ratio of 200% in such a manner that clear ink (deposition suppression ink) was ejected to the position on the absorber 21 at which ink was deposited in the state illustrated in FIG. 8B. Then, the resultant state of the absorber 21 was visually checked and evaluated for deposition. If the state where the surface of the absorber 21 is filled with ink or the state where ink is deposited up to a height higher than the surface has been visually observed, it is determined that ink is deposited.

Figure 8C:
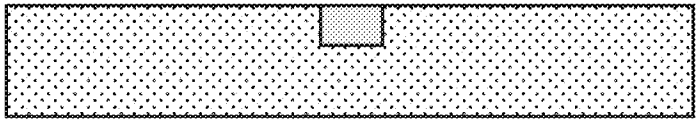
Figure 8D:
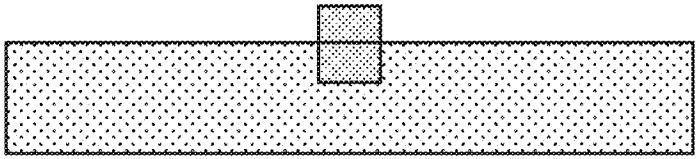

FIGS. 8C and 8D are schematic diagrams each illustrating a result of the above-described test using black ink, magenta ink, yellow ink, red ink, and cyan ink that are defined as the deposition ink. Among these types of ink, magenta ink, yellow ink, red ink, and cyan ink were brought into a state illustrated in FIG. 8C where the deposited ink is re-fluidized using the deposition suppression ink, the re-fluidized ink penetrates into the absorber 21, and the deposition is consequently eliminated. For the above-described reason, magenta ink, yellow ink, red ink, and cyan ink that can easily recover from the deposited state using the deposition suppression ink even if being deposited are defined as the re-fluidization ink.

On the other hand, as illustrated in FIG. 8D, it has been observed that black ink is deposited on the absorber 21 even after the test. For the above-described reason, black ink is defined as the aggregation ink. Pigment ink has a property of being easily aggregated. In particular, black ink is sometimes designed to be aggregated more easily than other colors in order to obtain a higher density. Thus, black ink in the deposited state is strongly solidified and is more difficult to recover from the deposited state as compared with the re-fluidization ink.

Here, because the ease of deposition is proportional to the amount of solid components, the above-described types of ink are classified as the deposition ink and the deposition suppression ink based on the amount of solid components. Alternatively, the above-described types of ink may be classified as the deposition ink and the deposition suppression ink based on the amount of solvent or moisturizing agent contained therein. This is because, if the deposition suppression ink contains a large amount of solvent, a rise in viscosity of ink can be suppressed, and ink can be made easily absorbable into the absorber 21. Thus, pigment ink that contains a large amount of solvent or moisturizing agent can also be easily absorbed into an ink absorber, and be classified as the deposition suppression ink. In addition, depending on the property of pigment, some types of pigment are easy to deposit, the other types of pigment are difficult to deposit. If ink contains a large amount of pigment, but the pigment has a property of being difficult to deposit, the ink may be classified as the deposition suppression ink.

(Evaluation of Deposition Resolution)

The following two tests were performed regarding a method for eliminating deposition of black ink which is the aggregation ink difficult to recover from the deposited state.

(Test 1)

An operation of performing borderless recording at a recording duty ratio of 25% using black ink (aggregation ink), and then performing borderless recording at a recording duty ratio of 125% using clear ink (deposition suppression ink) was repeated 500 times. The result shows a state illustrated in FIG. 8E, and the deposition was prevented from occurring.

As described above, it is possible to prevent the deposition of the aggregation ink from occurring by mixing the deposition suppression ink at a ratio equal to or larger than a predetermined ratio before the aggregation ink is solidified and deposited. In the test 1, the ratio between the black ink amount and the clear ink amount in one operation is 1:5.

(Test 2)

Figure 8E:
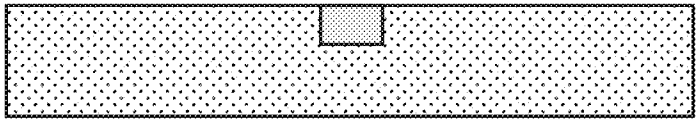
Figure 8F:
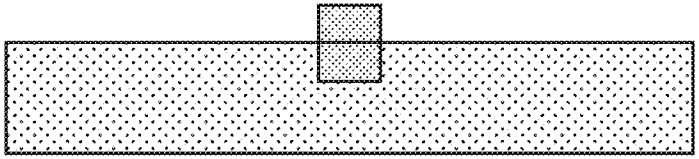

An operation of performing borderless recording at a recording duty ratio of 25% using black ink (aggregation ink), and then performing borderless recording at a recording duty ratio of 25% using clear ink (deposition suppression ink) was repeated 500 times. The result shows a state illustrated in FIG. 8F, and the deposition occurred. Then, clear ink was additionally ejected at a recording duty ratio of 200% onto the deposition in the state illustrated in FIG. 8F, and the deposition was eliminated (FIG. 8E).

From this result, it has been found out that, even if the amount of deposition suppression ink mixed into the aggregation ink in one operation is insufficient, the deposition can be eliminated by mixing the deposition suppression ink at a certain ratio or more and by additionally ejecting the deposition suppression ink when the aggregation ink is deposited.

In the test 2, the ratio of between the black ink amount and the clear ink amount in one operation is 1:1, and the clear ink amount corresponding to a recording duty ratio of 200% is used to eliminate the deposition after the operation 500 times. Thus, the clear ink amount used in the test 2 is the same as when the clear ink amount corresponding to a recording duty ratio of 25.4% (25%+200%/500 times) is used in one operation. In other words, the clear ink amount used in the test 2 is the same as when clear ink is ejected and mixed into black ink at a ratio of 25.4%/25%≠1.02 in one operation.

It has been found out that, while both the methods used in the tests 1 and 2 can eliminate the deposition, the method used in the test 2 can reduce the total consumption of deposition suppression ink to about ⅕. In addition, because the amount of ink ejected in one operation in the test 2 is smaller than that in the test 1, the ejection time of the deposition suppression ink in one operation can also be reduced.

In the present exemplary embodiment, ink deposition is suppressed using the method in the test 2. More specifically, when the aggregation ink is ejected in borderless recording, the deposition suppression ink corresponding to a recording duty ratio of 25% in the test 2 is ejected after completion of the recording, as the ink for the deposition suppression processing. If the detection sensor 13 determines that the ink is deposited on the absorber 21, the deposition suppression ink corresponding to a recording duty ratio of 200% in the test 2 is ejected to eliminate the deposition. The ratio of ink for the deposition suppression processing or ink for the deposition elimination processing to the aggregation ink in the test 2 is not limited to the ratio described in the test 2, and a suitable ratio can be set depending on the property of ink, an environmental temperature, and humidity. However, the amount of ink to be used for the deposition suppression processing in one operation is set to the amount smaller than the amount of ink to be ejected to eliminate the deposition after the detection of the deposition.

(Count of Number of Ejected Dots in Protruding Region)

Figure 9:
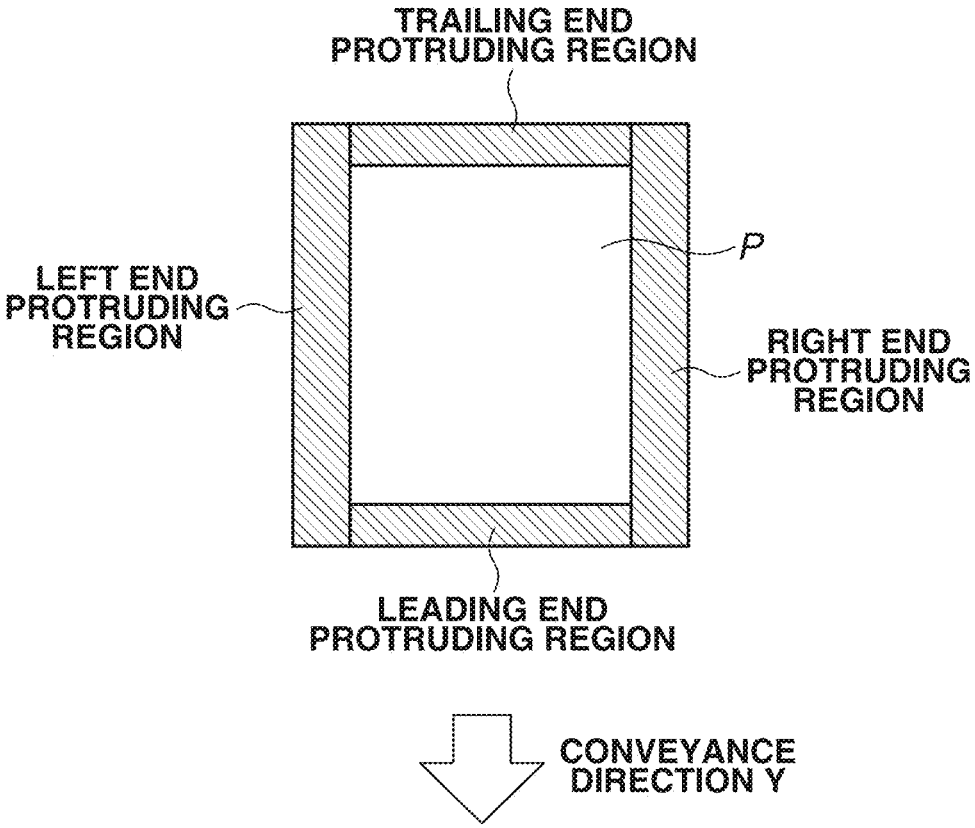
FIG. 9 is a diagram illustrating a protruding region in borderless recording according to the exemplary embodiment.

FIG. 9 is a diagram illustrating a region, outside the recording medium P, to which ink is ejected in borderless recording. As described above, when borderless recording is performed in the present exemplary embodiment, an image is recorded in the region protruding outward 3 mm from the leading end, the trailing end, the right end, and the left end of the recording medium P. The protruding region is illustrated in gray. If the CPU 300 receives a borderless recording command from the host apparatus, the CPU 300 causes the image signal processing unit 314 to generate recording data for borderless recording by enlarging image data to a size larger than the size of the recording medium P. By controlling the recording head 3 based on the recording data, borderless recording is performed. By counting the number of dots of each ink in the region of a 3-mm width inward from each end of the image, the number of dots ejected to the protruding region is counted. The CPU 300 counts the number of dots based on the recording data generated by the image signal processing unit 314. The counting can also be performed by another circuit. Here, the protruding region is classified into the leading end protruding region, the trailing end protruding region, the right end protruding region, and the left end protruding region outside the recording medium P. Ink ejected to the right end protruding region and ink ejected to the left end protruding region are respectively absorbed into the right end region and the left end region of the absorber 21 that are illustrated in FIG. 4. The number of dots is counted in each count region for each color. The right end region and the left end region are each regarded as one count region. Because the leading/trailing end region has a wide width, the region is further divided into ten regions, and each of the ten regions is regarded as one count region. The number of dots of each color in each region is counted when the image is recorded, and the counted number of dots is stored into the ROM 301.

(Deposition Suppression Processing)

The amount of ink to be used for the deposition suppression processing is determined based on the number of aggregation dots obtained by subtracting, from the aggregation ink ejected to each count region in borderless recording, the deposition suppression ink ejected with the aggregation ink in the same ejection operation. The number of aggregation dots can be obtained using Formula (1) to be described below. In the present exemplary embodiment, the ink to be ejected for the deposition suppression processing is clear ink.

$$\text{Number of aggregation dots} = \text{number of black dots} - (\text{number of light cyan dots} + \text{number of light magenta dots} + \text{number of gray dots} + \text{number of clear ink dots}) \quad (1)$$

In the present exemplary embodiment, by calculating the number of aggregation dots, which is the difference between the number of dots of aggregation ink and the number of dots of deposition suppression ink, information regarding the deposition state of the aggregation ink is acquired. Alternatively, for example, only the number of dots of aggregation ink may be calculated as the number of aggregation dots. In addition, the re-fluidization ink such as red ink may be included in counting the number of dots of aggregation ink (refer to Formula (2)). In the present exemplary embodiment, the number of ejected ink dots is counted. Alternatively, the ejected amount of ink or the ratio thereof may be calculated.

$$\text{Number of aggregation dots} = \text{number of black dots} + \text{number of magenta dots} + \text{number of yellow dots} + \text{number of red dots} + \text{number of cyan dots} - (\text{number of light cyan dots} + \text{number of light magenta dots} + \text{number of gray dots} + \text{number of clear ink dots}) \quad (2)$$

The ROM 301 prestores a table defining the number of ink dots (the number of dots) to be ejected for the deposition suppression processing that corresponds to the number of aggregation dots. The CPU 300 determines the number of deposition suppression ink dots to be ejected to each count region, based on the calculated number of aggregation dots in each count region.

In the present exemplary embodiment, the number of deposition suppression dots AT, which is the number of deposition suppression ink dots to be ejected for the deposition suppression processing is calculated using the following Formula (3).

$$\text{Number of deposition suppression dots} = \text{number of aggregation dots} \times M \quad (3)$$

The coefficient M is preset and indicates the ratio of the number of deposition suppression ink dots to the number of aggregation dots, which is required to re-fluidize the deposited aggregation ink. For example, when the result of the test 2 is applied, a recording duty ratio of 25% is required for clear ink with respect to a recording duty ratio of 25% for black ink, and thus the coefficient M is 1.

Figure 10:
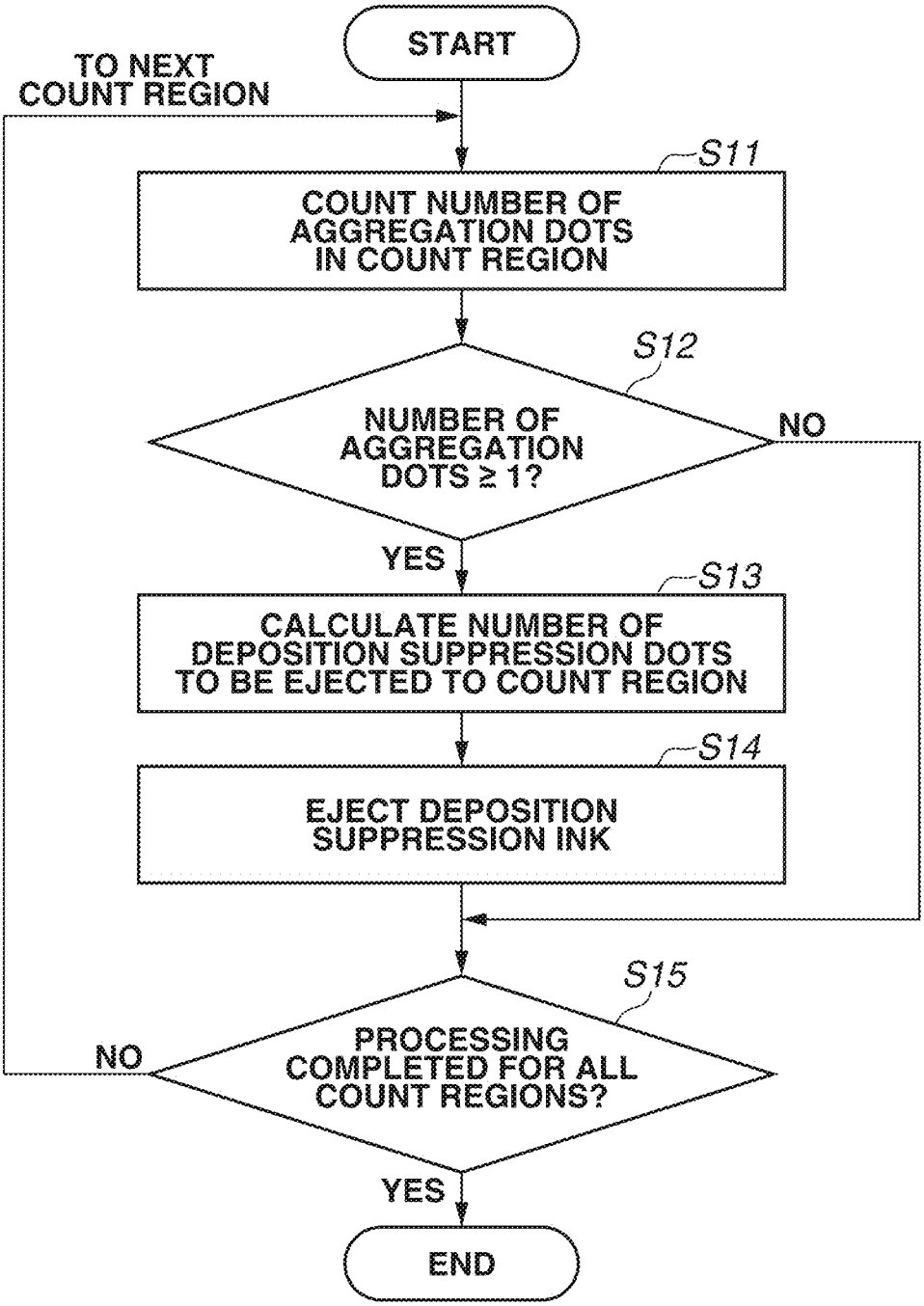
FIG. 10 is a flowchart illustrating deposition suppression processing according to the exemplary embodiment.

FIG. 10 is a flowchart illustrating a flow of the deposition suppression processing. The processing is executed by the CPU 300 loading a program stored in the ROM 301, into the RAM 302, and executing the program, for example. In the present exemplary embodiment, the processing is executed after borderless recording. In the present exemplary embodiment, the ink to be ejected for suppressing the occurrence of deposition is clear ink.

First of all, in step S11, the CPU 300 calculates the number of aggregation dots ejected to a count region of the absorber 21 in borderless recording, using the Formula (1).

Next, in step S12, the CPU 300 determines whether the number of aggregation dots is equal to or larger than 1. If the number of aggregation dots is less than 1 (NO in step S12), it is determined that the aggregation ink (black ink in the present exemplary embodiment) that is likely to deposit does not exist in the count region, and the processing proceeds to step S15. If the number of aggregation dots is equal to or larger than 1 (YES in step S12), it is determined that the aggregation ink that is likely to deposit exists in the count region, and the processing proceeds to step S13.

In step S13, the CPU 300 calculates the number of deposition suppression dots, more specifically, the number of dots of deposition suppression ink (clear ink in the present exemplary embodiment) to be ejected to the count region of the absorber 21 for the deposition suppression processing, using the Formula (3). Then, in step S14, the deposition suppression ink is ejected to the count region based on the number of dots calculated in step S13. When the deposition suppression ink is ejected in a state where the carriage 2 is stopped, the deposition suppression ink is ejected to the entire count region. Thus, the CPU 300 performs the processing in step S14 in the state where the carriage 2 is stopped.

In step S15, the CPU 300 determines whether the processing in steps S11 to S14 has been completed for all the count regions. If the processing has been completed for all the count regions (YES in step S15), the deposition suppression processing ends. If the processing has not been completed for all the count regions (NO in step S15), the processing in steps S11 to S14 is performed for the next count region.

In the above-described manner, the deposition suppression processing is completed. In the processing illustrated in FIG. 10, the deposition suppression ink is ejected for each count region in step S14, but the deposition suppression ink may be ejected after whether to eject the deposition suppression ink is determined for all the count regions. In this case, if it is necessary to eject the deposition suppression ink over a wide region on the absorber 21 such as the leading/trailing end region illustrated in FIG. 4, the deposition suppression ink may be ejected while the carriage 2 is moved.

In the above-described processing, the deposition suppression processing is executed after borderless recording. Alternatively, the deposition suppression processing may be performed at another timing after the injection operation of the aggregation ink. For example, when recording other than borderless recording is performed and preliminary ejection is executed during the recording or after the recording, the deposition suppression processing may be executed after the recording. Alternatively, the deposition suppression processing may be executed immediately after the preliminary ejection during the recording. Alternatively, the deposition suppression processing may be executed after preliminary ejection for recovering the ejection state of the recording head 3 before recording or at power-on of the recording apparatus 1. In addition, the deposition suppression processing may be executed for not only ink ejected to the absorber 21, but also for ink ejected to a preliminary ejection receiver for receiving preliminary ejection ink, and ink discharged to the cap 30. Hereinafter, a method for performing the deposition suppression processing after preliminary ejection will be described.

Figure 12:
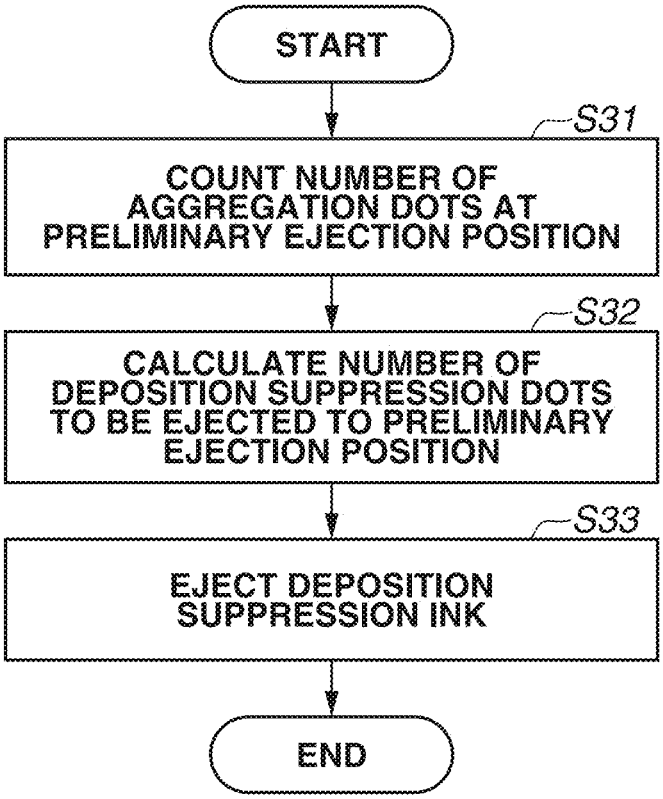
FIG. 12 is a flowchart illustrating the deposition suppression processing at a preliminary ejection position according to the exemplary embodiment.

FIG. 12 is a flowchart illustrating the deposition suppression processing performed at a preliminary ejection position. The processing is executed by the CPU 300 loading a program stored in the ROM 301, into the RAM 302, and executing the program, for example. In the present exemplary embodiment, the processing is executed after recording. The recording may be borderless recording or recording other than the borderless recording. Preliminary ejection is performed to prevent an ejection failure from occurring. In the present exemplary embodiment, 50 dots of each dark color ink (black, magenta, yellow, red, cyan) and 10 dots of each light color ink (light magenta, light cyan, gray, clear) are ejected onto the absorber 21 outside the recording medium P for one scan. All the types of ink are preliminarily ejected to the same position on the absorber 21. The position is referred to as the preliminary ejection position.

When 100 scans are performed to record an image on one recording medium P, if the Formula (1) in the present exemplary embodiment is applied, the number of aggregation dots per scan is as follows. It is assumed here that the preliminary ejection is performed every time one scan is completed. Alternatively, the preliminary ejection may be performed every time a predetermined number of scans are completed.

$$\text{Number of aggregation dots}=\text{number of black dots}-(\text{number of light cyan dots}+\text{number of light magenta dots}+\text{number of gray dots}+\text{number of clear ink dots})=50-(10+10+10+10)=10$$

Next, the number of dots of deposition suppression ink to be ejected to the preliminary ejection position for the deposition suppression processing is calculated using the Formula (3) in the present exemplary embodiment. In the Formula (3), M=1 is set.

$$\text{Number of deposition suppression dots}=\text{number of aggregation dots}\times M=10\times 1=10$$

If the Formulae (1) and (3) are applied as described above, for one scan, it is necessary to additionally eject 10 dots of clear ink as the deposition suppression ink for the deposition suppression processing separately from the preliminary ejection. More specifically, in order to complete recording one recording medium P, 1000 dots (10 dots×100 scans) of deposition suppression ink are required to be ejected for the deposition suppression processing.

In step S31, the CPU 300 calculates, using the Formula (1), the number of aggregation dots ejected to the preliminary ejection position of the absorber 21 in a preliminary ejection operation.

Next, in step S32, the CPU 300 calculates the number of deposition suppression dots based on the number of aggregation dots calculated in step S31. Then, in step S33, the deposition suppression ink is ejected to the preliminary ejection position based on the number of dots calculated in step S32.

In the above-described manner, the deposition suppression processing is performed at the preliminary ejection position.

In addition, at the time of borderless recording, the number of deposition suppression dots may be calculated by collectively counting the number of aggregation dots for preliminary ejection and the number of aggregation dots for borderless recording that are to be ejected to the preliminary ejection position.

(Deposition Elimination Processing)

Figure 11:
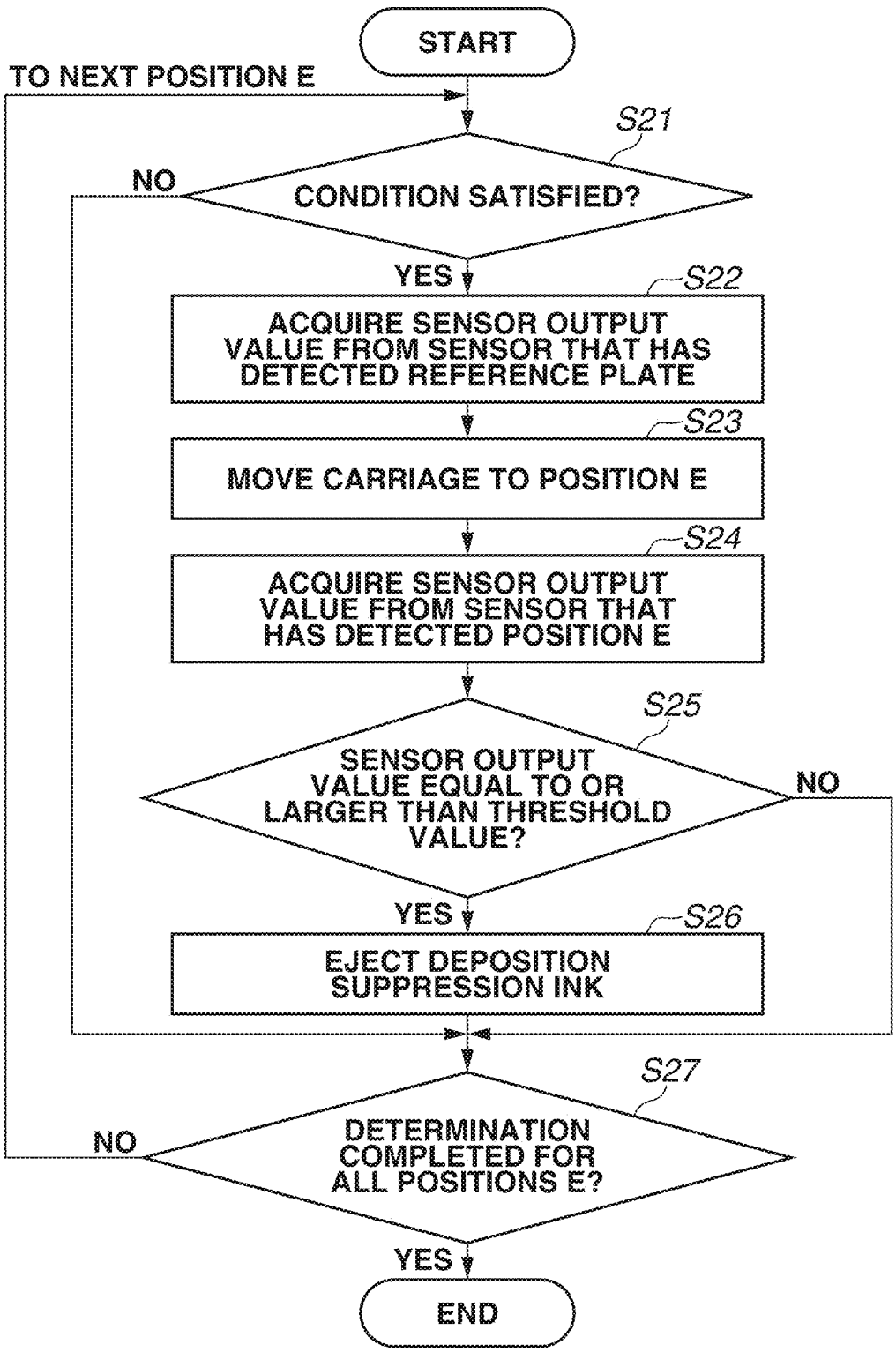
FIG. 11 is a flowchart illustrating deposition elimination processing according to the exemplary embodiment.

FIG. 11 is a flowchart illustrating the deposition elimination processing according to the present exemplary embodiment for eliminating ink deposition on the absorber 21. In the processing, it is determined whether there is a possibility of ink deposition, and if it is determined that there is a possibility of ink deposition, the detection sensor 13 detects the deposition state of the absorber 21. Then, if it is determined that ink deposition occurs, the deposition suppression ink is ejected to the position at which the deposition occurs. The deposition elimination processing is executed by the CPU 300 loading a program stored in the ROM 301, into the RAM 302, and executing the program, for example. The deposition elimination processing is performed after the deposition suppression processing is finished.

First of all, in step S21, the CPU 300 determines whether conditions for detecting ink deposition are satisfied. The conditions are preset and stored in the ROM 301. As the conditions, the number of sheets subjected to borderless recording is set to a predetermined number or more, and the humidity is set to a predetermined value or less. In the present exemplary embodiment, the number of sheets subjected to borderless recording is set to 500 or more, and the humidity is set to 10% or less. Information regarding the number of sheets subjected to borderless recording and the humidity that is stored in the ROM 301 is updatable. The information is updated as necessary, and each time the information is updated, the updated information is stored into the ROM 301. In this step, the CPU 300 acquires the information from the ROM 301 to compare the information with the conditions, and determines whether the conditions are satisfied. If all the conditions are satisfied (YES in step S21), the processing proceeds to step S22 to perform detection. If any one of the conditions is unsatisfied (NO in step S21), the detection is not performed, and the processing proceeds to step S27. The conditions are not limited to the above-described conditions. As the conditions, the time elapsed from the last time the deposition state is detected may be set to a predetermined time or more such as 100 hours or more, and the remaining amount of deposition suppression ink to be ejected to eliminate the deposition may be set to a predetermined amount or more such as 10% or more with respect to the capacity. As the conditions, conditions under which ink deposition can occur, or conditions under which ink deposition can be eliminated if detected can be set. In addition, the detection may be performed if all the conditions are satisfied, or the detection may be performed if any of the conditions is satisfied.

If it is determined in step S21 that all the condition are satisfied (YES in step 21), the processing proceeds to step S22. In step S22, the carriage 2 is moved to a position at which the reference plate 14 is detectable, and the reference plate 14 is detected to acquire a sensor output value Y (v). The sensor output value Y (v) varies depending on aging degradation of the detection sensor 13. The sensor output value Y (v) acquired in this step is used to correct the sensor output value to be acquired in step S24 to be described below.

Next, in step S23, the carriage 2 is moved to a position at which the deposition state at the position E of the absorber 21 is detectable. Then, in step S24, the detection sensor 13 emits light to the position E and receives reflected light from the position E, so that a sensor output value Z (v) corresponding to the amount of received reflected light is acquired. After this step, a sensor output value Z (v)/Y (v) is used, which is obtained by correcting the sensor output value Z (v) with the sensor output value Y (v) acquired in step S21.

In step S25, the CPU 300 determines whether the sensor output value Z (v)/Y (v) acquired in step S24 is equal to or larger than the threshold value X (v). As described above with reference to FIGS. 7A to 7C, if the sensor output value is equal to or larger than the threshold value X (v), it is determined that ink is deposited at the position E, and the processing proceeds to step S26 based on the detection result. If the sensor output value is less than the threshold value X (v), it is determined that ink is not deposited at the position E, and the processing proceeds to step S27 based on the detection result.

In step S26, the deposition suppression ink is ejected to the position E. The deposition suppression ink to be ejected is preset to a certain amount.

In step S27, the CPU 300 determines whether the determination has been completed for all the positions E. If the determination has been completed for all the positions E (YES in step S27), the deposition elimination processing ends. If the determination has not been completed for all the positions E (NO in step S27), the processing returns to step S21, and the processing is performed for the next position E.

In the above-described manner, the deposition elimination processing is completed. In addition, in the processing illustrated in FIG. 11, the deposition suppression ink is ejected for each position E in step S26. Alternatively, the deposition suppression ink may be ejected after whether to eject the deposition suppression ink is determined for all the positions E. In this case, if it is necessary to eject the deposition suppression ink over a wide region on the absorber 21 such as the leading/trailing end region illustrated in FIG. 4, the deposition suppression ink may be ejected while the carriage 2 is moved. In addition, the deposition state in the leading/trailing end region may be detected while the carriage 2 is moved. In addition, in step S26, an operation of ejecting a predetermined amount of deposition suppression ink, detecting the deposition state at the position E, and if it is determined that the deposition still exists, ejecting the deposition suppression ink again may be repeated. In this case, if the deposition is eliminated, the processing may proceed to step S27.

When ink is ejected from the recording head 3, part of the ejected ink becomes mist and drifts in the recording apparatus 1. If the reference plate 14 is soiled by the mist, an erroneous output value is detected even when the detection sensor 13 is not deteriorated. In this case, if the detected value is used for correction, an erroneous result is detected. Thus, if the sensor output value (Y) (v) acquired when the reference plate 14 is detected in step S22 exceeds a preset range, the CPU 300 may determine not to perform the subsequent processing because a correct value cannot be calculated. The range preset for the sensor output value (Y) (v) is larger than an error caused by the deterioration of the detection sensor 13.

By performing the above-described processing, even when the aggregation ink difficult to recover from the deposited state once being deposited is ejected onto the absorber 21, it is possible to eliminate the deposition and also reduce the amount of ink required to eliminate the deposition.

In the above-described exemplary embodiment, clear ink is used as the deposition suppression ink for suppressing deposition in the deposition suppression processing, and is used as the deposition suppression ink for eliminating deposition in the deposition elimination processing, but another type of deposition suppression ink may be used. Alternatively, a plurality of types of deposition suppression ink may be used. For example, light cyan ink and clear ink can be used as the deposition suppression ink. It is desirable that when the plurality of types of deposition suppression ink is used, the ink to be used in a smaller amount in recording is used in a higher ratio in the processing. For example, if light cyan ink and clear ink are used as the deposition suppression ink and the amount of clear ink to be used is larger in recording, light cyan ink and clear ink may be used in a ratio of 2:1 in the processing.

While in the present exemplary embodiment, the description has been given using pigment ink as an example, the present exemplary embodiment can be applied to any apparatus that can eject a liquid that contains solid components and is easy to deposit, and a liquid that can re-fluidize deposited solid components.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-211539, filed Nov. 22, 2019, which is hereby incorporated by reference herein in its entirety.

What is claimed is:

1. An ejection apparatus comprising:

a platen configured to support a recording medium;

an absorber provided in the platen and configured to absorb a liquid;

an ejection unit configured to eject a plurality of types of ink including at least a first liquid containing a component to be deposited in a case where the first liquid is ejected onto the absorber, and a second liquid being a different type of liquid from the first liquid and being capable of suppressing deposition of the first liquid;

a detection unit configured to detect a state of a predetermined region of the absorber; and a control unit configured to control the detection unit to detect the state of the predetermined region, and control the ejection unit to eject the second liquid to the predetermined region based on a result of the detection by the detection unit, wherein, in a case where the first liquid is ejected to the predetermined region in an ejection operation, the control unit controls the ejection unit to eject the second liquid to the predetermined region after the ejection of the first liquid to the predetermined region is finished, without using the result of the detection by the detection unit.

2. The ejection apparatus according to claim 1, further comprising a determination unit configured to determine an amount of the second liquid to be ejected to the predetermined region by the ejection unit controlled by the control unit, in a case where the first liquid is ejected to the predetermined region in the ejection operation.

3. The ejection apparatus according to claim 2, wherein the determination unit determines the amount of the second liquid to be ejected to the predetermined region by the ejection unit controlled by the control unit, based on an amount of liquid determined to cause deposition in the predetermined region.

4. The ejection apparatus according to claim 3, wherein the amount of liquid determined to cause deposition in the predetermined region is an amount of the first liquid ejected to the predetermined region.

5. The ejection apparatus according to claim 3, wherein the amount of liquid determined to cause deposition in the predetermined region is obtained by subtracting, from an amount of the first liquid ejected to the predetermined region, an amount of the second liquid ejected with the first liquid within the same ejection operation.

6. The ejection apparatus according to claim 1, wherein, in a case where the first liquid is ejected to the predetermined region in the ejection operation, the control unit controls the ejection unit to eject the second liquid to the predetermined region after the ejection of the first liquid to the predetermined region is finished, without the detection by the detection unit.

7. The ejection apparatus according to claim 1, wherein, in a case where the result of the detection by the detection unit does not indicate that deposition occurs in the predetermined region, the control unit controls the ejection unit not to eject the second liquid to the predetermined region, and in a case where the result of the detection by the detection unit indicates that deposition occurs in the predetermined region, the control unit controls the ejection unit to eject the second liquid to the predetermined region.

8. The ejection apparatus according to claim 1, wherein an amount of the second liquid to be ejected to the predetermined region in a case where the first liquid is ejected to the predetermined region in the ejection operation is smaller than an amount of the second liquid to be ejected to the predetermined region based on the result of the detection by the detection unit.

9. The ejection apparatus according to claim 1, wherein a number of times of ejecting the second liquid to the predetermined region based on the result of the detection by the detection unit detecting the state of the predetermined region is smaller than a number of times of ejecting the second liquid to the predetermined region based on the ejection of the first liquid to the predetermined region.

10. The ejection apparatus according to claim 1, wherein the ejection unit is further capable of ejecting a third liquid, and wherein, in a case where deposition is caused by the third liquid ejected onto the absorber, it is easier to re-fluidize the deposition by ejecting the second liquid to the deposition, than in a case where deposition is caused by the first liquid ejected onto the absorber.

11. The ejection apparatus according to claim 10, wherein, in a case where it is determined that the first liquid is not ejected to the predetermined region and the third liquid is ejected to the predetermined region in the ejection operation, the control unit controls, based on the ejection of the third liquid, the ejection unit to eject the second liquid to the predetermined region after the ejection operation is finished, without using the result of the detection by the detection unit.

12. The ejection apparatus according to claim 10, wherein, in a case where it is determined that the first liquid and the third liquid are not ejected to the predetermined region in the ejection operation, the control unit controls the ejection unit not to eject the second liquid to the predetermined region after the ejection operation is finished.

13. The ejection apparatus according to claim 1, wherein, in a case where a predetermined condition is satisfied, the control unit controls the detection unit to detect a deposition state in the predetermined region, and controls the ejection unit to eject the second liquid to the predetermined region based on a result of the detection by the detection unit.

14. The ejection apparatus according to claim 13, wherein the predetermined condition includes at least one of a number of sheets of the recording medium subjected to a borderless recording operation being a predetermined number or more, a remaining amount of the second liquid being a predetermined amount or more, or a humidity being a predetermined value or less, the borderless recording operation ejecting a liquid to the recording medium and to a region outside the recording medium, the liquid being for recording an image.

15. The ejection apparatus according to claim 1, wherein the first liquid to be ejected to the predetermined region in the ejection operation is ejected in a preliminary ejection operation performed by the ejection unit, the preliminary ejection operation ejecting a liquid to a region different from the recording medium, the liquid not contributing to recording an image, and wherein the predetermined region is the region to which the liquid is ejected in the preliminary ejection operation.

16. The ejection apparatus according to claim 1, wherein the ejection operation is a borderless recording operation performed by the ejection unit, the borderless recording operation ejecting a liquid to the recording medium and to a region outside the recording medium, the liquid being for recording an image, and wherein the predetermined region is the region outside the recording medium to which the liquid is ejected in the borderless recording operation.

17. The ejection apparatus according to claim 1, wherein the detection unit includes a light emission unit and a light receiving unit, the light emission unit being configured to emit light to the predetermined region of the absorber, the light receiving unit being configured to receive reflected light of the light emitted from the light emission unit to the predetermined region.

18. The ejection apparatus according to claim 1, further comprising a reference plate for checking whether the detection unit is capable of acquiring a normal detection result, wherein in a case where the detection unit is determined to be capable of acquiring a normal detection result in detecting the reference plate, the detection unit detects the predetermined region, and in a case where the detection unit is determined to be not capable of acquiring a normal detection result in detecting the reference plate, the detection unit does not detect the predetermined region.

19. The ejection apparatus according to claim 18, wherein the reference plate is provided near a position at which the ejection unit stands by when not operating.

20. The ejection apparatus according to claim 1, wherein a percentage of a pigment component contained in the first liquid is higher than a percentage of a pigment component contained in the second liquid.

21. The ejection apparatus according to claim 20, wherein the second liquid includes at least one of clear ink or light cyan ink.

* * * * *